US008239989B2

(12) United States Patent
Im et al.

(10) Patent No.: US 8,239,989 B2
(45) Date of Patent: Aug. 14, 2012

(54) METHOD FOR REMOVING ODOR OF LAUNDRY IN WASHING MACHINE

(75) Inventors: Myong-Hun Im, Seoul (KR); Soo-Young Oh, Seoul (KR); Jae-Won Chang, Seoul (KR); Kyung-Chul Woo, Seoul (KR); Kyeong-Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 870 days.

(21) Appl. No.: 12/021,763

(22) Filed: Jan. 29, 2008

(65) Prior Publication Data

US 2008/0178397 A1 Jul. 31, 2008

(30) Foreign Application Priority Data

Jan. 30, 2007 (KR) ..... 10-2007-0009654

(51) Int. Cl.
*D06B 19/00* (2006.01)

(52) U.S. Cl. ..... 8/149.3; 8/149.1; 8/149.2; 68/3 R; 68/5 C; 68/5 R

(58) Field of Classification Search ..... 8/149.1, 8/149.2, 149.3; 68/3 R, 5 C, 5 R
See application file for complete search history.

(56) References Cited

U.S. PATENT DOCUMENTS

| | | | | |
|---|---|---|---|---|
| 2004/0139557 | A1* | 7/2004 | Seo et al. | 8/159 |
| 2005/0092035 | A1* | 5/2005 | Shin et al. | 68/275 |
| 2005/0262644 | A1* | 12/2005 | Oak et al. | 8/158 |
| 2006/0010613 | A1* | 1/2006 | Jeon et al. | 8/158 |

FOREIGN PATENT DOCUMENTS

| | | | |
|---|---|---|---|
| EP | 1 600 545 | A1 | 11/2005 |
| WO | WO-2004/059070 | A1 | 7/2004 |

* cited by examiner

*Primary Examiner* — Joseph L Perrin
*Assistant Examiner* — Benjamin Osterhout
(74) *Attorney, Agent, or Firm* — Birch, Stewart, Kolasch & Birch, LLP

(57) ABSTRACT

A method for removing odor of laundry in a washing machine comprises inputting laundry into an inner tub, supplying steam to the laundry, and rotating the inner tub. Odor of the laundry is rapidly and easily removed without performing a cleaning process using water, and the fabrication cost is reduced.

17 Claims, 14 Drawing Sheets

METHOD FOR REMOVING ODOR OF LAUNDRY IN WASHING MACHINE

CROSS-REFERENCE TO RELATED APPLICATIONS

This nonprovisional application claims priority under 35 U.S.C. §119(a) on Patent Application No. 10-2007-0009654 filed in Korea on Jan. 30, 2007, the entire contents of which are hereby incorporated by reference.

BACKGROUND OF THE INVENTION

1. Field of the Invention

The present invention relates to a method for removing odor of laundry in a washing machine, and more particularly, to a method for removing odor of laundry in a washing machine without performing a cleaning process using water.

2. Description of the Background Art

Generally, a washing machine serves to wash laundry with a cleaning process using water by rotating an inner tub, wherein the inner tub is rotatably installed inside an outer tub that contains water therein. The washing machine performs a cleaning process by supplying steam into an inner tub so as to reduce the amount of water and power.

As shown in FIG. 1, the washing machine comprises a cabinet 11, an outer tub 21 received in the cabinet 11, and an inner tub 31 rotatably installed in the outer tub 21.

An opening 12 through which laundry is introduced and a door 13 are provided at a front surface of the cabinet 11. The outer tub 21 is supported in the cabinet 11 by a spring 22 and a damper 23.

The outer tub 21 has a cylindrical shape of which one side is opened, and the inner tub 31 is rotatably installed in the outer tub 21. The inner tub 31 has a cylindrical shape of which one side is opened, and a plurality of through holes 33 are formed on a circumferential surface thereof. A plurality of lifts 35 for lifting laundry are provided on an inner surface of the inner tub 31.

A driving motor 25 for rotating the inner tub 31 is coupled to a rear end of the outer tub 21. A drain passage 27 having a drain pump 28 is provided below the inner tub 31 so as to drain water.

A detergent supplying unit 41 for supplying detergent is provided above the outer tub 21, and a water supply pipe 43 is connected to the detergent supplying unit 41. A water supply valve 45 is provided at the water supply pipe 43.

However, in the conventional washing machine, washing, rinsing, and/or dehydrating processes are performed according to a driving mode. Therefore, a cleaning process using water has to be performed when odor of laundry is to be removed, thereby wasting water and power. Furthermore, the cleaning process using water causes the laundry to have a shortened life-span.

SUMMARY OF THE INVENTION

Therefore, it is an object of the present invention to provide a method for removing odor of laundry in a washing machine without performing a cleaning process using water.

It is another object of the present invention to provide a method for removing odor of laundry in a washing machine without requiring a high fabrication cost.

To achieve these and other advantages and in accordance with the purpose of the present invention, as embodied and broadly described herein, a method for removing odor of laundry in a washing machine is provided. The washing machine comprises: a cabinet; an outer tub installed in the cabinet, the outer tub having an inlet port and an outlet port; an inner tub rotatably installed in the outer tub; and a steam generating unit disposed outside the outer tub for generating steam and supplying the steam into the outer tub. The method comprises: inputting laundry into the inner tub; supplying the steam to the laundry; and rotating the inner tub.

According to another aspect of the present invention, a method for removing odor of laundry in a washing machine is provided. The washing machine comprises: a cabinet; an outer tub installed in the cabinet, the outer tub having an inlet port and an outlet port; an inner tub rotatably installed in the outer tub; an odor removing module disposed at the inlet port, the odor removing module having a fan for supplying external air into the outer tub; and a steam generating unit disposed outside the outer tub for generating steam and supplying the steam into the outer tub. The method comprises inputting laundry into the inner tub; supplying the steam to the laundry; and driving the fan of the odor removing module.

According to still another aspect of the present invention, a method for removing odor of laundry in a washing machine is provided. The washing machine comprises: a cabinet; an outer tub installed in the cabinet, the outer tub having an inlet port and an outlet port; an inner tub rotatably installed in the outer tub; an odor removing module disposed at the inlet port, the odor removing module having a fan and a heater for supplying external air into the outer tub; and a steam generating unit disposed outside the outer tub for generating steam and supplying the steam into the outer tub. The method comprises inputting laundry into the inner tub; supplying the steam to the laundry; and driving the odor removing module.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE ILLUSTRATED EMBODIMENTS

Figure 1:
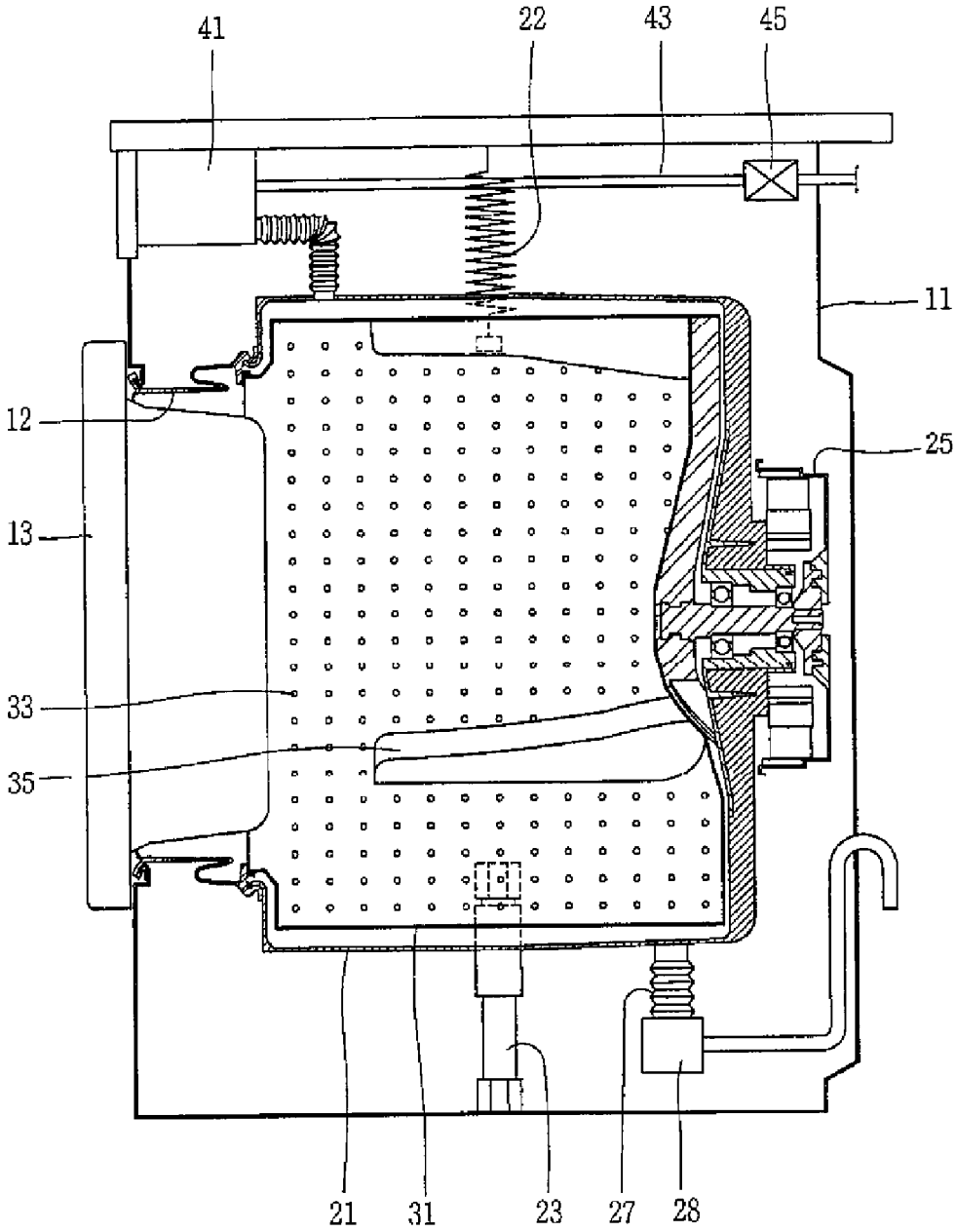
FIG. 1 is a sectional view showing a washing machine in accordance with the related art.

The present invention will now be described in detail with reference to the accompanying drawings, wherein the same reference numerals will be used to identify the same or similar elements throughout the several views. It should be noted that the drawings should be viewed in the direction of orientation of the reference numerals.

Hereinafter, a method for removing odor of laundry in a washing machine according to the present invention will be explained in more detail.

Figure 2:
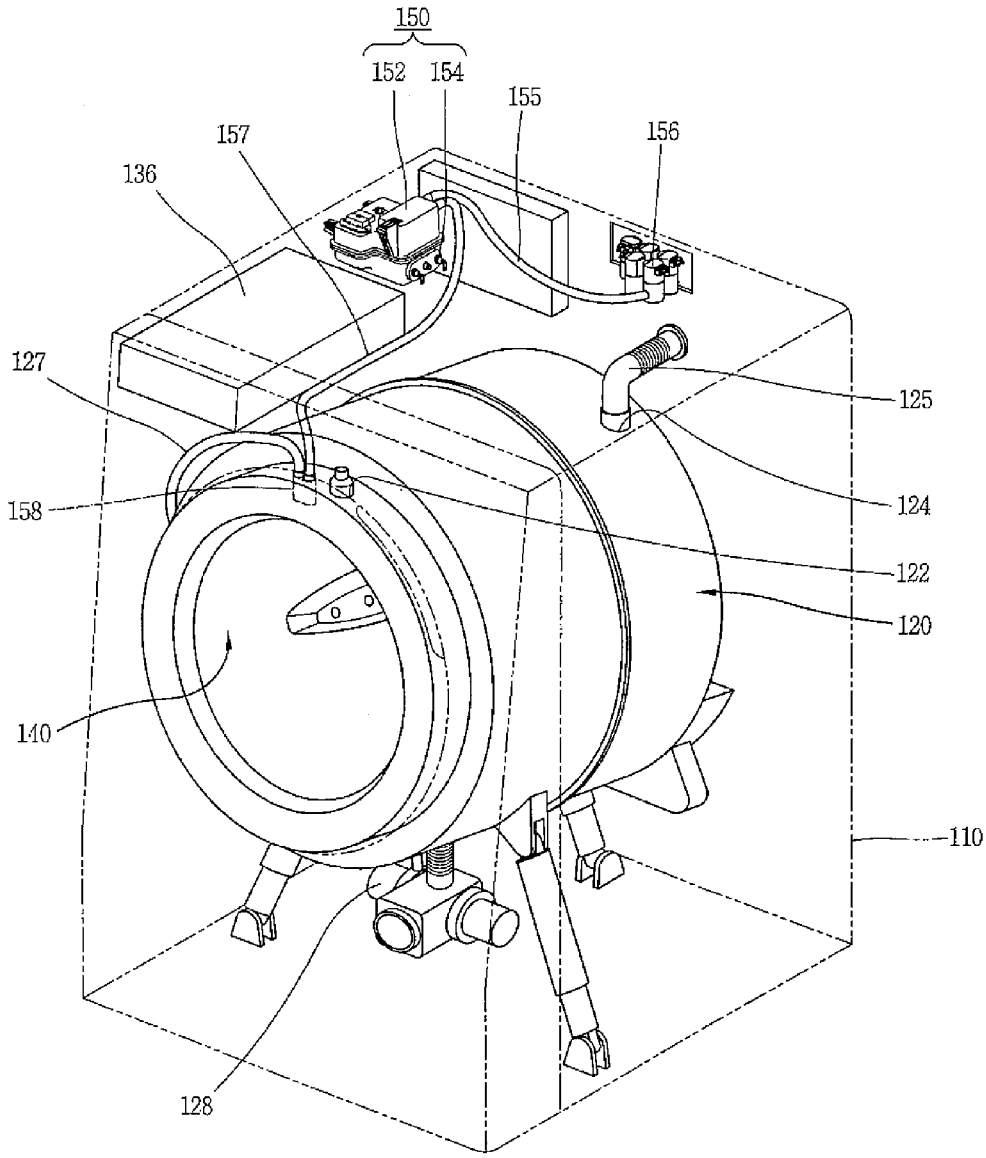
FIG. 2 is a configuration view of a washing machine, to which a method for removing odor of laundry according to the first embodiment of the present invent may be applied.

As shown in FIG. 2, a washing machine comprises a cabinet 110; an outer tub 120 installed in the cabinet 110; an inner tub 140 rotatably installed in the outer tub 120; and a steam generating unit 150 disposed in the cabinet 110 for generating steam and supplying the steam into the outer tub 120.

Figure 3:
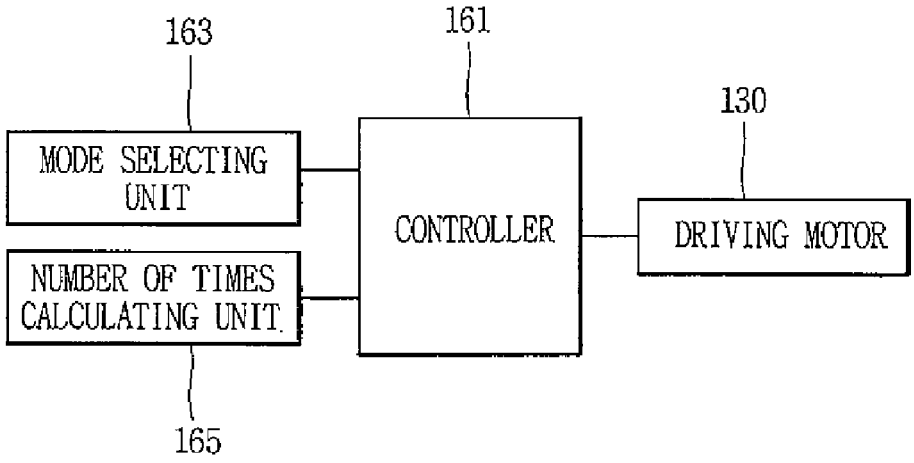
FIG. 3 is a block diagram for controlling the washing machine of FIG. 1.

A driving motor 130 as shown in FIG. 3 for rotating the inner tub 140 is coupled to a rear end of the outer tub 120. An inlet port 122 and an outlet port 124 through which air is introduced and exhausted are formed at the outer tub 120. The inlet port 122 is formed at a front region of the outer tub 120, and the outlet port 124 is formed at a rear region of the outer tub 120. An outlet pipe 125 is connected to the outlet port 124 so as to exhaust air outside the cabinet 110. At the outer tub 120, a circulation passage 127 is formed, through which water inside the washing machine is drawn to be circulated into the outer tub 120. A circulation pump 128 is provided at the circulation passage 127.

A detergent supplying unit 136 for supplying detergent is provided in the cabinet 110, and a steam generating unit 150 for supplying steam into the outer tub 120 is installed at one side of the detergent supplying unit 136. The steam generating unit 150 includes a case 152, and a heater 154 installed in the case 152. A water supply pipe 155 and a steam supply pipe 157 are connected to the case 152, respectively. A water supply valve 156 is installed at the water supply pipe 155, and the steam supply pipe 157 is connected to an injection unit 158.

As shown in FIG. 3, to a controller 161 implemented as a microprocessor and having a control program, is connected to a mode selecting unit 163 for selecting one of a plurality of modes including an odor removing mode, connected to a driving motor 130 for rotating the inner tub 140 in the odor removing mode, and connected to a number of times calculating unit 165 for calculating the number of times the inner tub 140 was rotated during the driving time after the inner tub 140 is stopped. Here, the number of times the inner tub 140 was rotated is calculated by calculating a number of times the inner tub 140 was rotated for a certain driving time with a preset speed.

Figure 4:
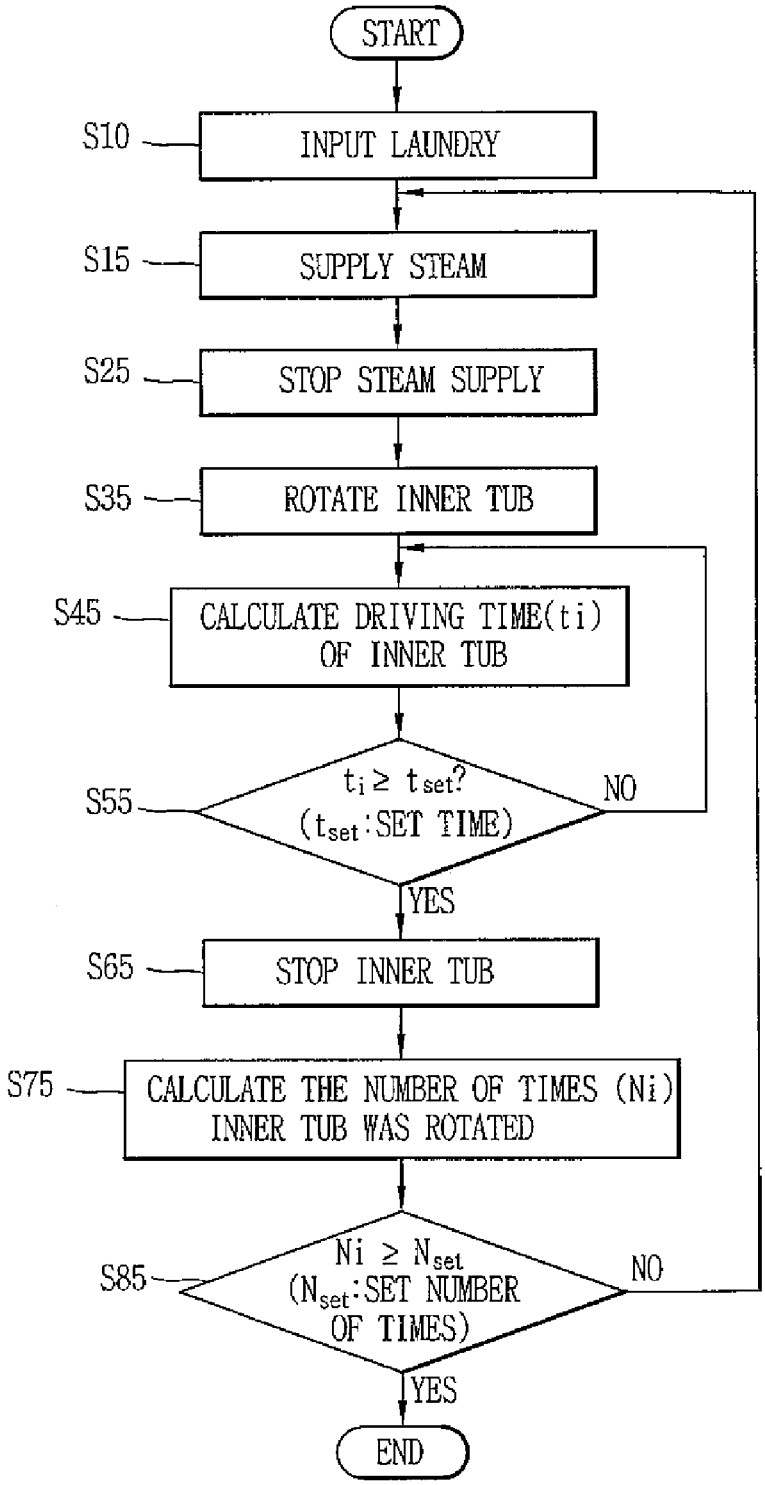
FIG. 4 is a flowchart showing a method for removing odor of laundry in a washing machine according to the first embodiment of the present invention.

Hereinafter, a method for removing odor of laundry in a washing machine according to the first embodiment of the present invention will be explained with reference to FIG. 4.

First, laundry to be odor-removed is put into the inner tub 140 (S10). When an odor removing mode is selected by the mode selecting unit 163, the controller 161 controls to supply water from the water supply valve 156 of the steam generating unit 150. Then, the controller 161 controls to supply steam into the outer tub 120 from the heater 154 (S15). When a preset time for steam supply lapses, the controller 161 controls to stop the steam supply from the heater 154 (S25). Here, the controller 161 may control the inner tub 140 to be rotated for a certain time (e.g., several tens of seconds to several hundreds of seconds) with a preset speed (e.g., 40 rpm-100 rpm). The controller 161 may be also configured so as to rotate the inner tub 140 with a preset speed in one direction or in forward and backward directions.

When the steam supply is stopped, the controller 161 controls to rotate the inner tub 140 via the driving motor 130 so as to remove moisture inside the laundry (S35). Here, the inner tub 140 is set to have a speed high enough to dehydrate the laundry (e.g., more than 400 rpm or a normal dehydration speed). When the inner tub 140 is rotated, the laundry is dehydrated, and air sucked through the inlet port 122 is exhausted out through the outlet port 124. Accordingly, the odor-removing process for the laundry is accelerated.

When the inner tub 140 is rotated, the controller 161 calculates a driving time of the inner tub 140 (S45). If the calculated driving time is more than a preset time (S35), the controller 161 controls to stop the inner tub 140 via the driving motor 130 (S65). Here, the number of times calculating unit 165 calculates the number of times the inner tub 140 was rotated during the driving time (S75). When the calculated number of times is less than a preset number of times (S85), the controller 161 controls the process to be repeated until the accumulated calculated number of times reaches the preset number of times.

Figure 5:
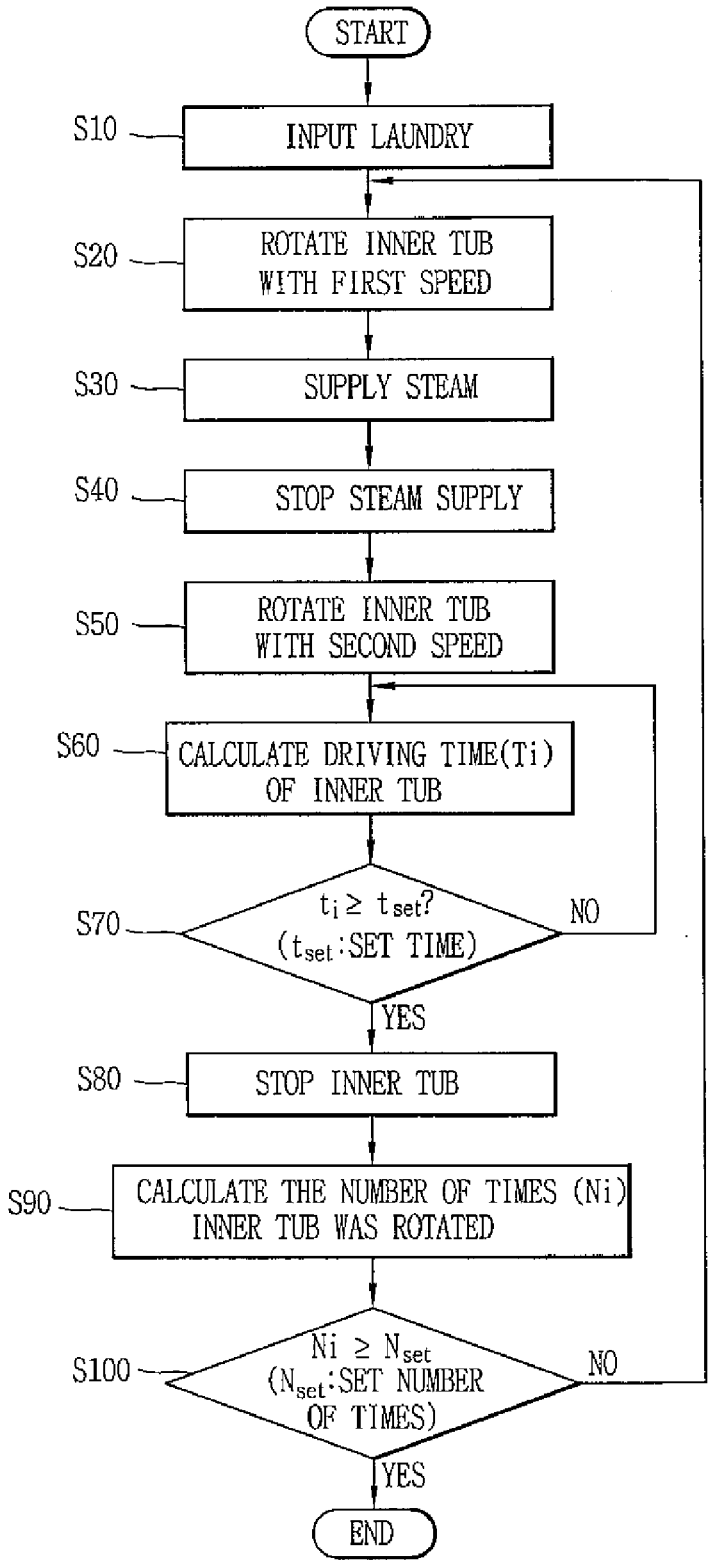
FIG. 5 is a flowchart showing a method for removing odor of laundry in a washing machine according to the second embodiment of the present invention.

Hereinafter, a method for removing odor of laundry in a washing machine according to the second embodiment of the present invention will be explained with reference to FIG. 5.

First, laundry is put into the inner tub 140 (S10). When an odor removing mode is selected by the mode selecting unit 163, the controller 161 controls the inner tub 140 to be rotated with a first speed (e.g., 40 rpm-100 rpm) via the driving motor 130 (S20). Step 20 is performed so as to evenly contact the laundry with air. The controller 161 controls to supply water via the water supply valve 156 of the steam generating unit 150. Then, the controller 161 controls to supply steam into the outer tub 120 from the heater 154 of the steam generating unit 150 (S30).

Next, when a preset time for steam supply lapses, the controller 161 controls to stop the steam supply from the heater 154 (S40). Next, the controller 161 controls the inner tub 140 to be rotated with a second speed via the driving motor 130 (S50). Here, the second speed is set to be high enough to dehydrate the laundry (e.g., more than 400 rpm or a normal dehydration speed). When the inner tub 140 is rotated with the second speed, the laundry is dehydrated, and air is sucked and exhausted through the inlet port 122 and the outlet port 124. More specifically, the air sucked into the outer tub 120 is introduced into the inner tub 140, and then is exhausted out through the outlet port 124 and the outlet pipe 125 together with the air inside the inner tub 140. During the process, as an odorous material of the laundry is exhausted out together with the air, odor of the laundry is removed.

The controller 161 calculates a driving time of the inner tub 140 (S60). Here, when the calculated driving time of the inner tub 140 is more than a preset time (S70), the controller 161 controls to stop the inner tub 140 via the driving motor 130 (S80). Here, the number of times calculating unit 165 calculates the number of times the inner tub 140 was rotated during the calculated driving time (S90). When the calculated number of times the inner tub 140 was rotated is less than a preset number of times (S100), the above processes are repeatedly performed until the accumulated calculated number of times reaches the preset number of times.

Figure 6:
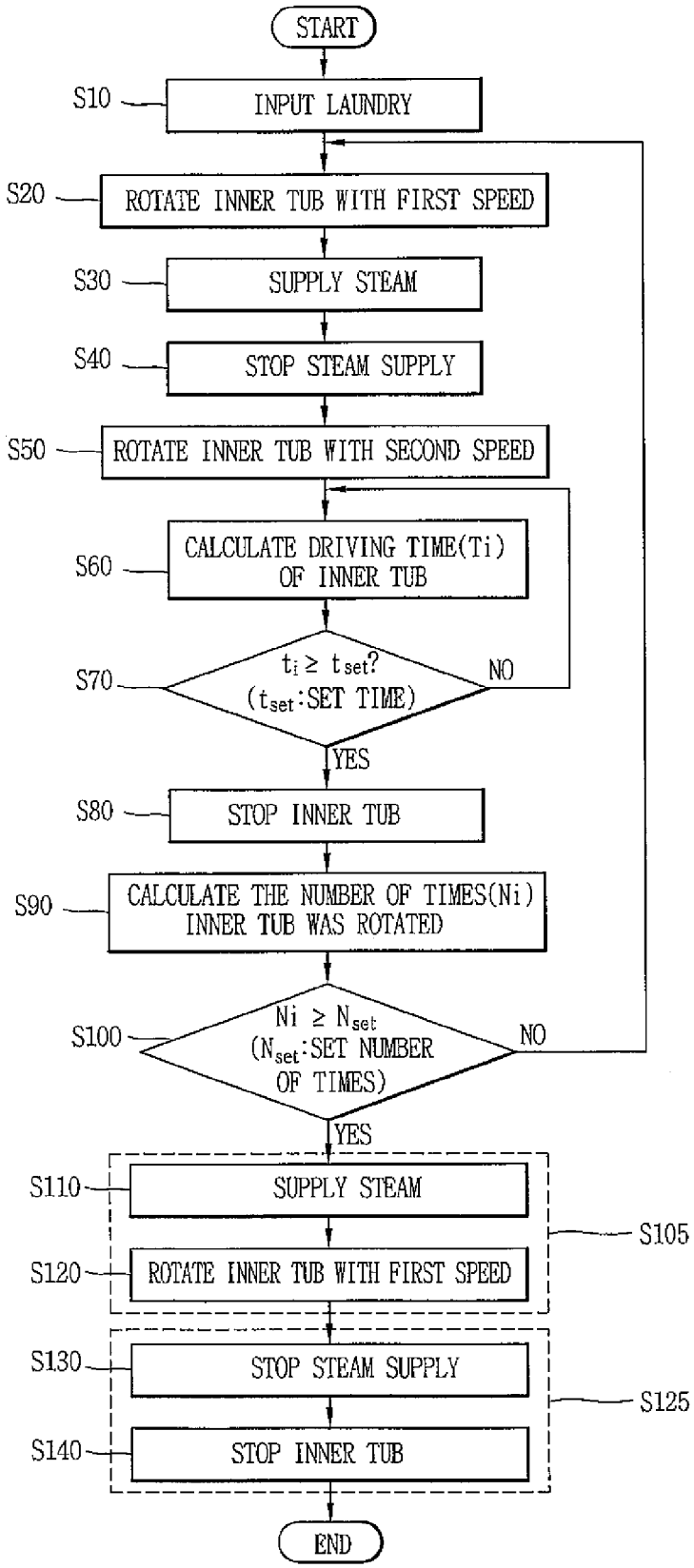
FIG. 6 is a flowchart showing a method for removing odor of laundry in a washing machine according to the third embodiment of the present invention.

Hereinafter, a method for removing odor of laundry in a washing machine according to the third embodiment of the present invention will be explained with reference to FIG. 6.

The method for removing odor of laundry in a washing machine according to a third embodiment of the present invention comprises: putting laundry into the inner tub 140 (S10); rotating the inner tub 140 with a first speed (S20); supplying steam into the laundry and stopping the steam supply (S30, S40); rotating the inner tub 140 with a second speed faster than the first speed so that the laundry can be dehydrated and external air can be sucked to be exhausted (S50); and removing wrinkle of the laundry (S105) when the number of times the inner tub 140 was rotated is more than a preset number of times, after repeating the S20, S30, S40 and S50 by a preset number of times.

At step S105 for removing wrinkle of the laundry, wrinkle of the laundry is removed by supplying a small amount of moisture into the laundry and rotating the laundry with a low speed. Step S105 for removing wrinkle of the laundry includes supplying steam into the laundry so as to supply a small amount of moisture (S110), and rotating the inner tub 140 (S120). Here, steps S110 and S140 may be performed nearly simultaneously. Step S110 may also be performed after step S120.

After step S105 for removing wrinkle of the laundry, the method further comprises cooling the laundry (S125). Step S125 includes stopping the steam supply (S130), and stopping the inner tub 140 after the inner tub 140 was rotated for a certain time in a state that the steam supply is stopped (S140). At step S125 for cooling the laundry, the inner tub 140 is rotated with a first speed.

Hereinafter, a method for removing odor of laundry in a washing machine according to the fourth and fifth embodiments of the present invention will be explained with reference to FIGS. 7 to 11.

Figure 7:
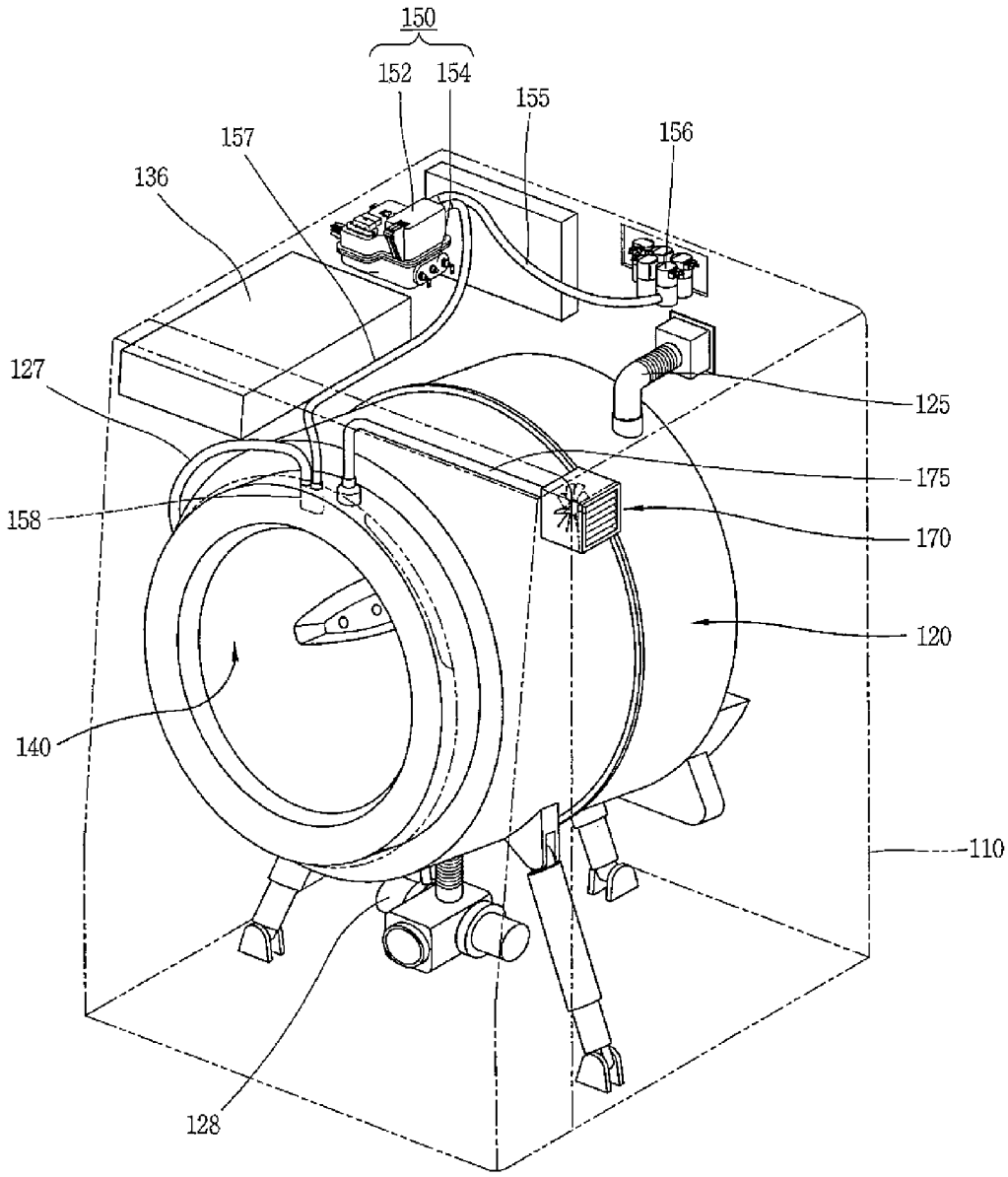
FIG. 7 is a configuration view of a washing machine, to which a method for removing odor of laundry according to the fourth and fifth embodiments of the present invent may be applied.

As shown in FIG. 7, a washing machine comprises a cabinet 110, an outer tub 120 installed in the cabinet 110, an inner tub 140 rotatably installed in the outer tub 120, a steam generating unit 150 disposed in the cabinet 110 for generating steam and supplying it into the outer tub 120, and an odor removing module 170 for supplying external air into the outer tub 120.

A driving motor 130 as shown in FIG. 3 for rotating the inner tub 140 is coupled to a rear end of the outer tub 120. An inlet port 122 and an outlet port 124 through which air is introduced and exhausted are formed at the outer tub 120. The inlet port 122 is formed at a front region of the outer tub 120, and the outlet port 124 is formed at a rear region of the outer tub 120. An outlet pipe 125 is connected to the outlet port 124 so as to exhaust air outside the cabinet 110. At the outer tub 120, is formed a circulation passage 127 through which water inside the washing machine is drawn to be circulated into the outer tub 120. A circulation pump 128 is provided at the circulation passage 127.

A steam generating unit 150 for supplying steam into the outer tub 120 is installed in the cabinet 110. The steam generating unit 150 includes a case 152, and a heater 154 installed in the case 152. A water supply pipe 155 and a steam supply pipe 157 are connected to the case 152, respectively. A water supply valve 156 is installed at the water supply pipe 155, and a communication hole 113 communicated with outside is formed at one side of the cabinet 110. The odor removing module 170 is installed at the communication hole 113.

Figure 8:
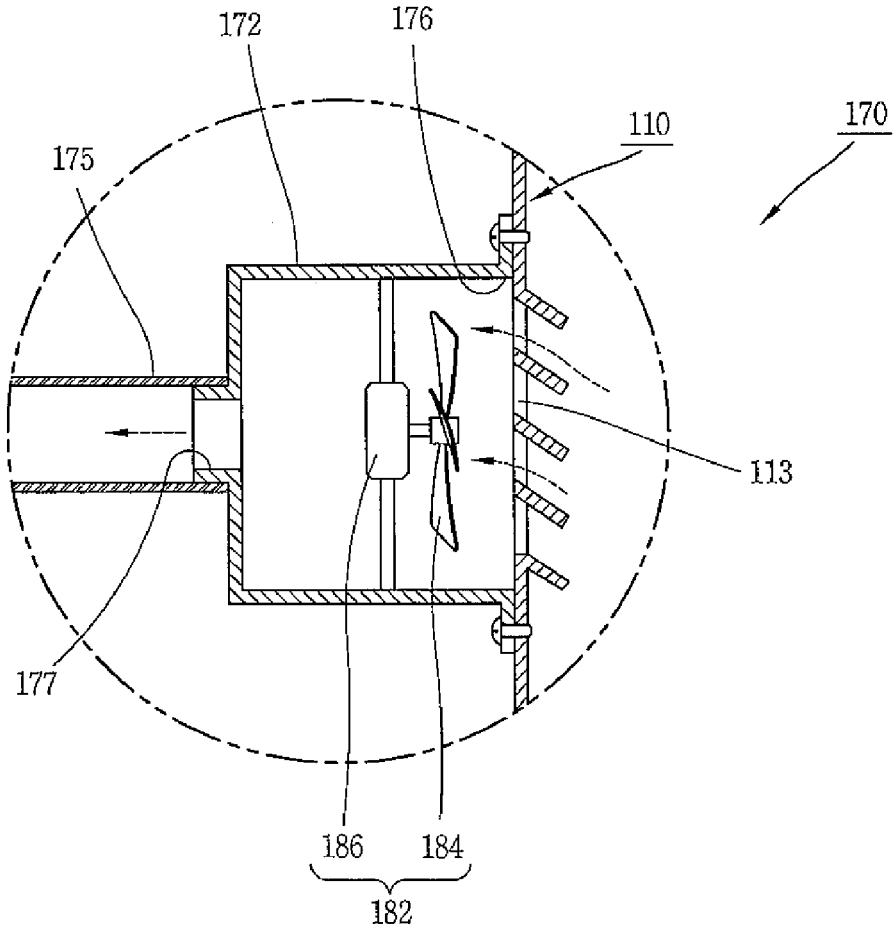
FIG. 8 is a sectional view of an odor removing module of FIG. 7.

As shown in FIG. 8, the odor removing module 170 includes a case 172 having a receiving space therein and having a suction opening 176 and a discharge opening 177, and a fan 182 rotatably installed in the case 172. The fan 182 includes a blade 184, and a driving motor 186 for driving the blade 184. One end of an inlet pipe 175 is connected to the inlet port 122, and another end of the inlet pipe 175 is connected to the discharge opening 177.

Figure 9:
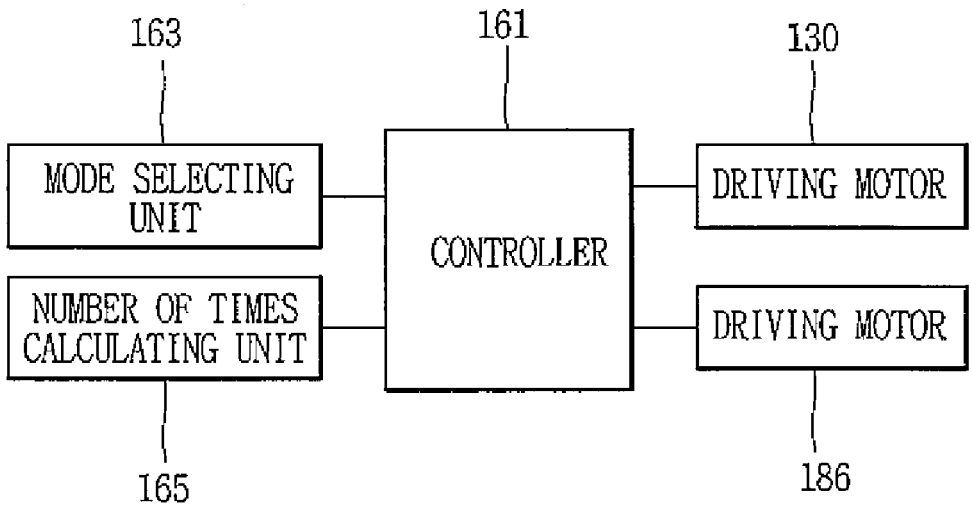
FIG. 9 is a block diagram showing a method for controlling the washing machine of FIG. 7.

As shown in FIG. 9, a controller 161 is connected to a mode selecting unit 163 for selecting one of a plurality of modes including an odor removing mode, connected to a number of times calculating unit 165 for calculating the number of times the odor removing module 170 is driven, connected to a driving motor 186 for driving the fan 182, and connected to a driving motor 130 for driving the inner tub 140.

Figure 10:
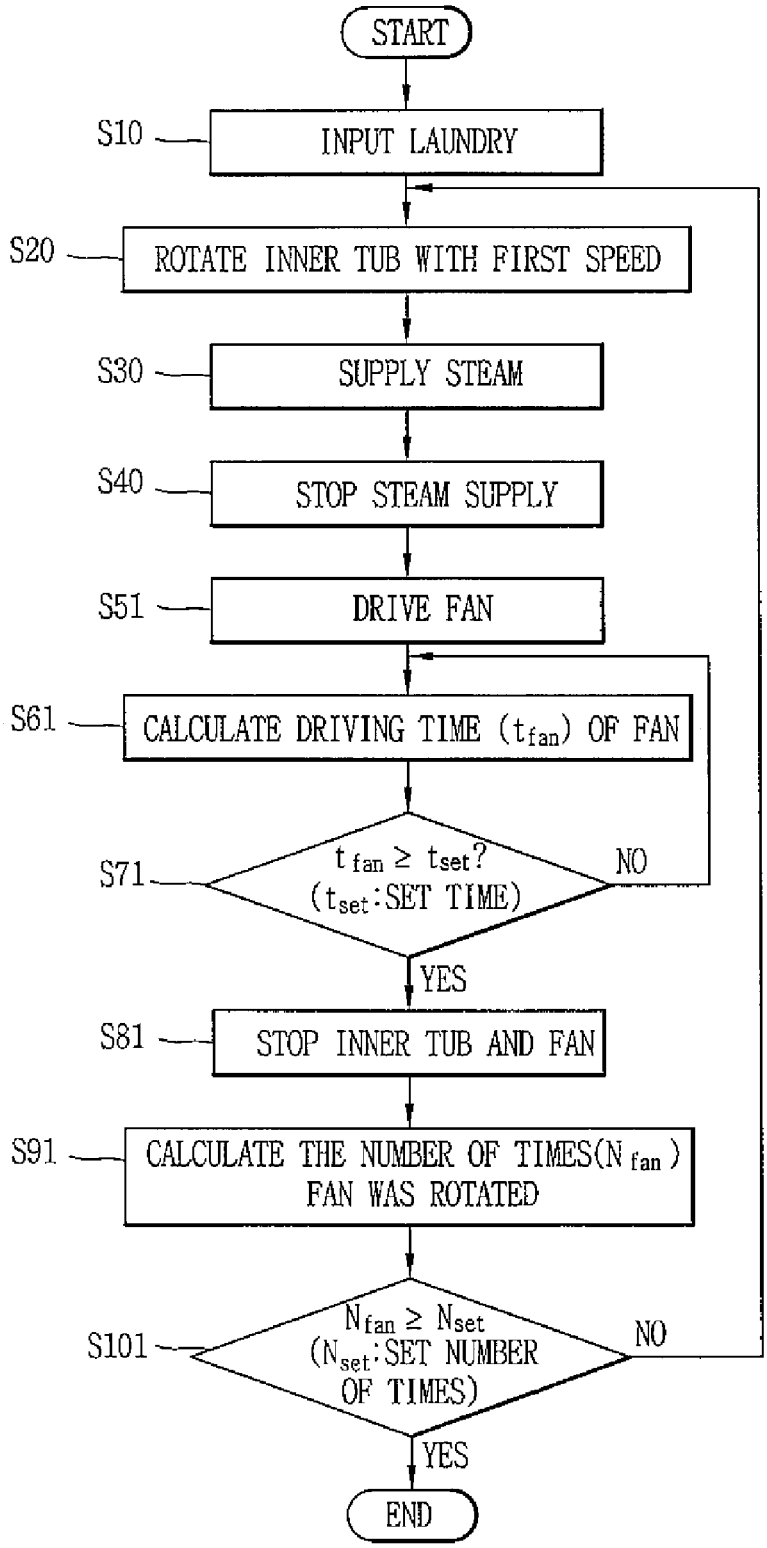
FIG. 10 is a flowchart showing a method for removing odor of laundry in a washing machine according to the fourth embodiment of the present invention.

Hereinafter, a method for removing odor of laundry in a washing machine according to the fourth embodiment of the present invention will be explained with reference to FIG. 10.

First, laundry is put into the inner tub 140 (S10). When an odor removing mode is selected by the mode selecting unit 163, the controller 161 controls to rotate the inner tub 140 with a first speed via the driving motor 130 (S20). Then, the controller 161 controls to supply water into the case 152 from the water supply valve 156 of the steam generating unit 150. In addition, the controller 161 controls to supply steam into the inner tub 140 from the heater 154 (S30). When a preset time for steam supply lapses, the controller 161 controls to stop the steam supply from the heater 154 (S40).

Next, the controller 161 drives the fan 182 so that air can be supplied into the inner tub 140 (S51). Once the fan 182 is driven, air outside the cabinet 110 is introduced into the outer tub 120 through the inlet port 122. Then, the air introduced into the outer tub 120 is exhausted outside the cabinet 110 through the outlet port 124 and the outlet pipe 125 via inside of the outer tub 120. Through the steps of supplying steam and sucking/discharging air, an odorous material of the laundry is exhausted out together with the air thereby to remove odor of the laundry.

The controller 161 calculates a driving time of the fan 182 (S61). When the calculated driving time of the fan 182 is more than a preset driving time (S71), the controller 161 controls to stop the inner tub 140 and the fan 182 (S81). After the fan 182 is stopped, the controller 161 calculates a number of times the fan 182 was rotated during the calculated driving time (S91). When the calculated number of times the fan 182 was rotated is less than a preset number of times (S101), the controller 161 repeatedly performs step S20 for rotating the inner tub 140 with a first speed through step S101 for comparing the accumulated calculated number of times the fan 182 was rotated with the preset number of times.

Figure 11:
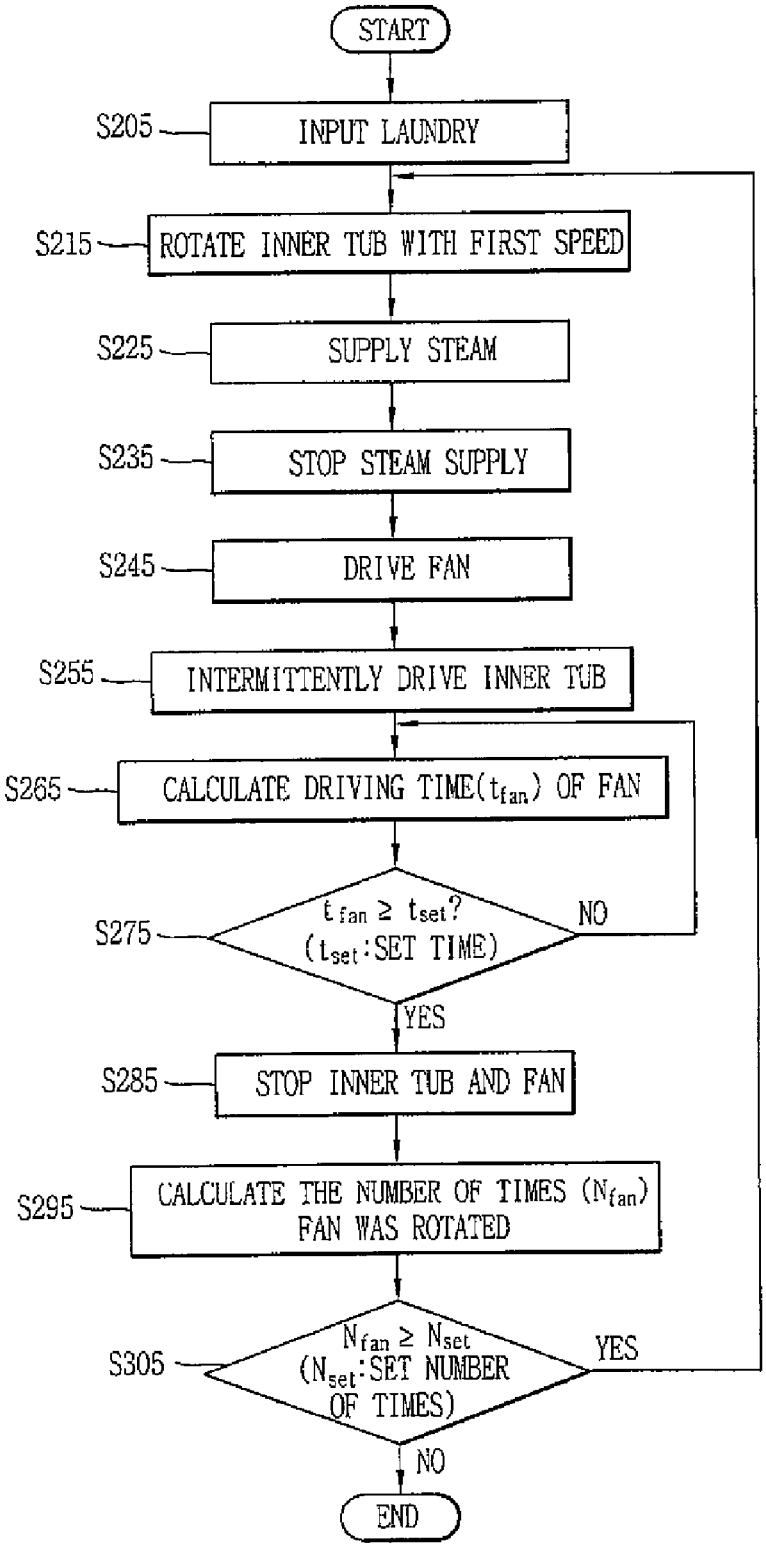
FIG. 11 is a flowchart showing a method for removing odor of laundry in a washing machine according to the fifth embodiment of the present invention.

Hereinafter, a method for removing odor of laundry in a washing machine according to the fifth embodiment of the present invention will be explained with reference to FIG. 11.

First, laundry is put into the inner tub 140 (S205). When an odor removing mode is selected by the mode selecting unit 163, the controller 161 controls to rotate the inner tub 140 with a first speed via the driving motor 130 (S215). Then, the controller 161 controls to supply steam into the laundry from the heater 154 of the steam generating unit 150 (S225). When a preset time for steam supply lapses, the controller 161 controls to stop the steam supply from the heater 154 (S235). And, the controller 161 controls to stop the inner tub 140 via the driving motor 130 (S245).

Next, the controller 161 drives the fan 182 so that external air can be supplied to the laundry (S255), and intermittently drives the inner tub 140 via the driving motor 130 (S265). As the inner tub 140 is intermittently driven, the laundry is smoothly stirred so as to rapidly remove odor. The controller 161 calculates a driving time of the fan 182 (S275). When the calculated driving time of the fan 182 is more than a preset driving time (S285), the controller 161 controls to stop the inner tub 140 and the fan 182 (S295). The controller 161 calculates a number of times the fan was rotated during the calculated driving time (S305).

When the calculated number of times the fan 182 was rotated is less than a preset number of times (S315), the controller 161 repeatedly performs step S215 for rotating the inner tub 140 with a first speed through step S315 for comparing the accumulated calculated number of times the fan 182 was rotated with the preset number of times.

Hereinafter, a method for removing odor of laundry in a washing machine according to the sixth embodiment of the present invention will be explained with reference to FIGS. 12 to 15.

Figure 12:
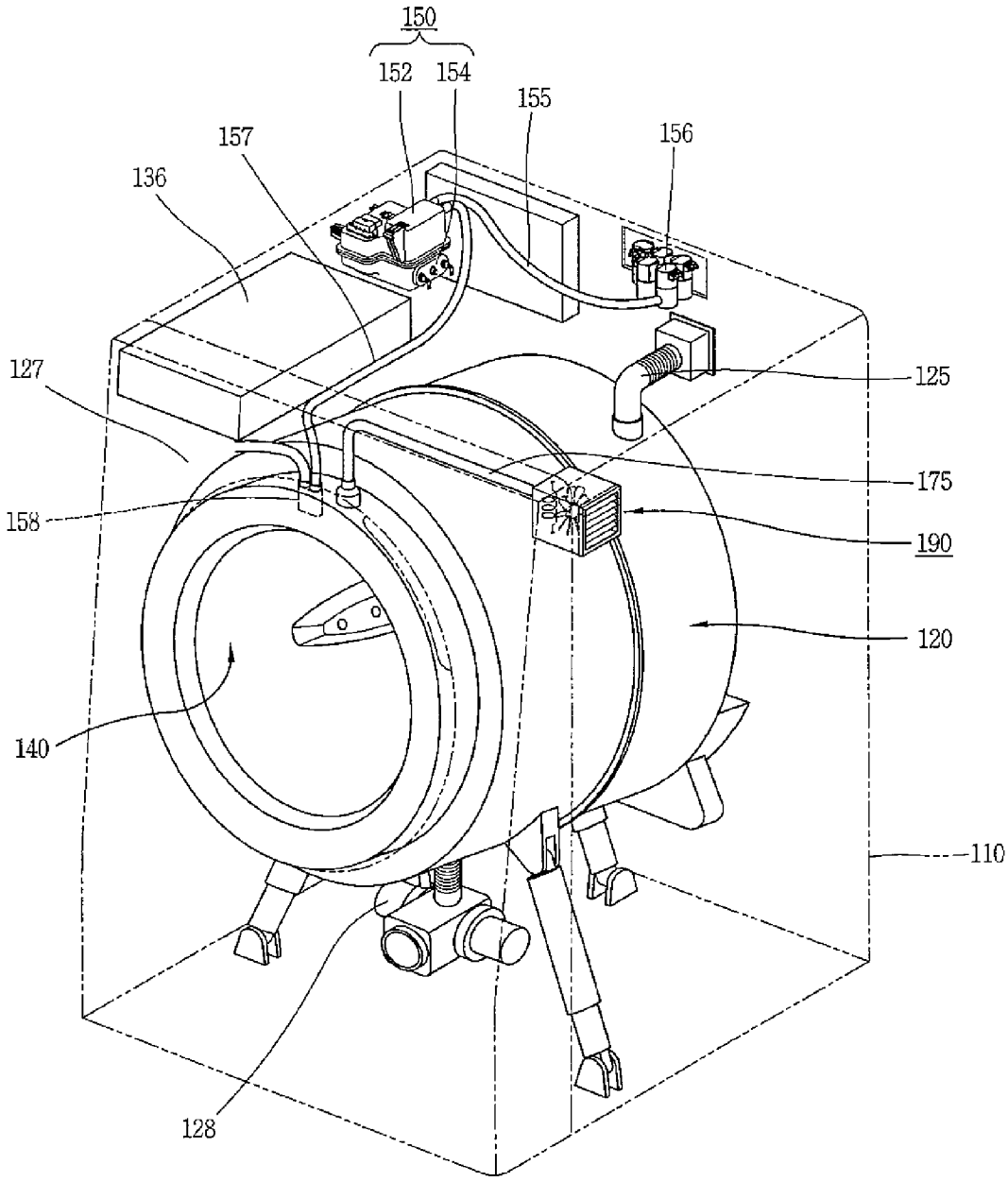
FIG. 12 is a configuration view of a washing machine, to which a method for removing odor of laundry in a washing machine according to the sixth embodiment of the present invention may be applied.

As shown in FIG. 12, a washing machine comprises a cabinet 110, an outer tub 120 installed in the cabinet 110, an inner tub 140 rotatably installed in the outer tub 120, a steam generating unit 150 disposed in the cabinet 110 for generating steam and supplying it into the outer tub 120, and an odor removing module 190 for supplying external air into the outer tub 120.

A steam generating unit 150 for supplying steam into the outer tub 120 is installed in the cabinet 110. The steam generating unit 150 includes a case 152, and a heater 154 installed in the case 152. A water supply pipe 155 and a steam supply pipe 157 are connected to the case 152, respectively. A water supply valve 156 is installed at the water supply pipe 155.

An inlet port 122 and an outlet port 124 through which air is introduced and exhausted are formed at the outer tub 120. An outlet pipe 125 is connected to the outlet port 124, and one end of an inlet pipe 175 is connected to the inlet port 122. The odor removing module 190 is installed at another end of the inlet pipe 175.

Figure 13:
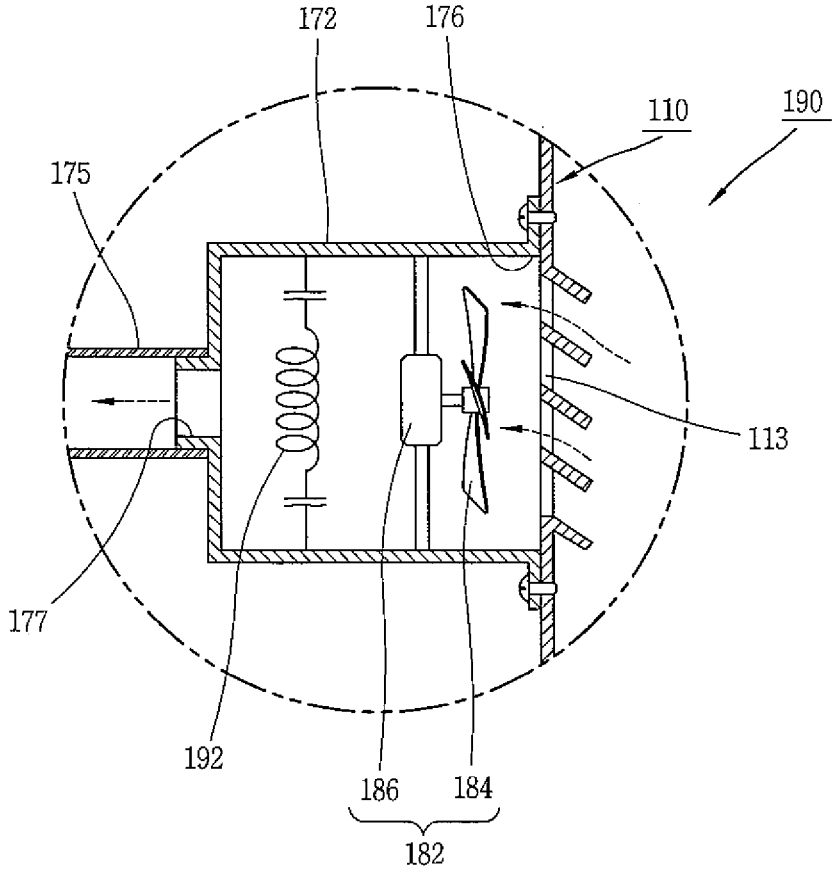
FIG. 13 is a sectional view of an odor removing module of FIG. 12.

As shown in FIG. 13, the odor removing module 190 includes a case 172 having a suction opening 176 and a discharge opening 177, the suction opening 176 communicated with a communication hole 113 of the cabinet 110; a fan 182 rotatably installed in the case 172; and a heater 192 disposed in the case 172 for heating air. Here, the fan 182 and the heater 192 are respectively configured to have a small capacity so as to supply warm air (e.g., air of 30° C.-40° C.) into the inner tub 140. For instance, the fan 182 has a rotation diameter of about 40 mm-80 mm, and the heater 192 has consumption power of about 200 W-600 W).

Figure 14:
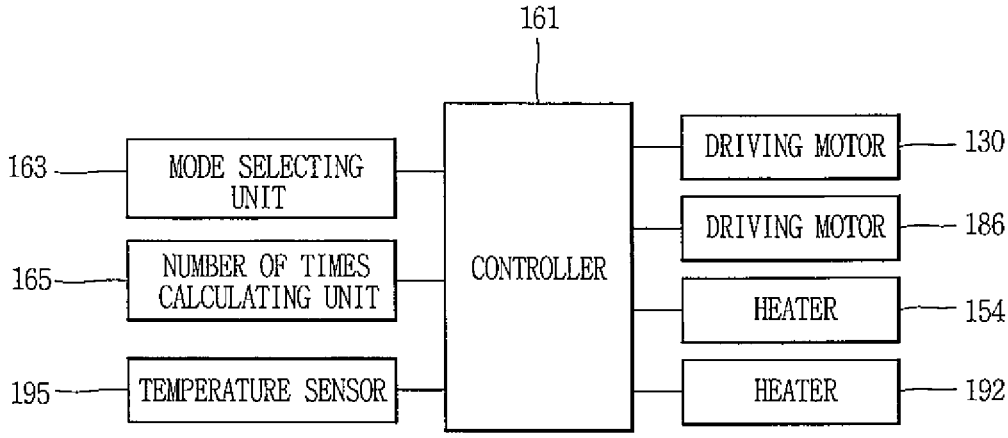
FIG. 14 is a block diagram showing a method for controlling the washing machine of FIG. 12.

As shown in FIG. 14, the controller 161 is connected to a mode selecting unit 163 for selecting one of a plurality of modes including an odor removing mode; a number of times calculating unit 165 for calculating the number of times the fan 182 was rotated in the odor removing mode; a temperature sensor 195 for sensing an air temperature at the lower side of the heater 192; a driving motor 130 for driving the inner tub 140, the fan 182, and the heater 192; a driving motor 186 for driving the fan 182; and a heater 192. The odor removing mode includes an external air supply mode for supplying external air into the inner tub 140 by rotating only the fan 182, and a warm air supply mode for supplying warm air (e.g., air of 30° C.-40° C.) into the inner tub 140 by driving the fan 182 and the heater 192.

Figure 15:
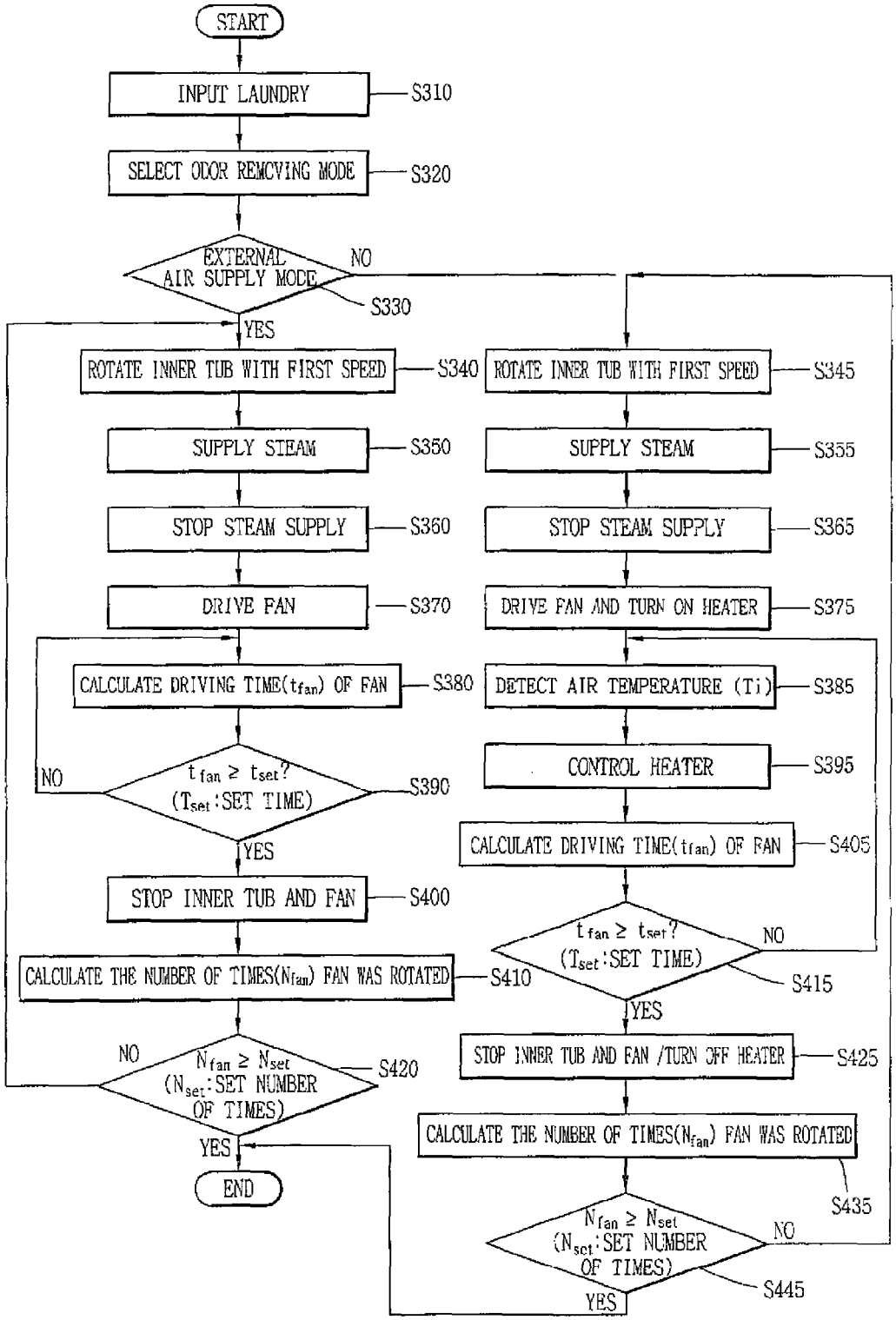
FIG. 15 is a flowchart showing a method for removing odor of laundry in a washing machine according to the sixth embodiment of the present invention.

Hereinafter, a method for removing odor of laundry in a washing machine according to the fifth embodiment of the present invention will be explained with reference to FIG. 15.

First, laundry is put into the inner tub 140 (S310). When an odor removing mode is selected by the mode selecting unit 163, the controller 161 judges whether to select an external air supply mode (S330). When the external air supply mode is selected (S330), the controller 161 controls to rotate the inner tub 140 with a first speed by the driving motor 130 (S340). And, the controller 161 controls to supply steam into the inner tub 140 from the heater 154 of the steam generating unit 150 (S350).

When a preset time for steam supply to the laundry lapses, the controller 161 controls to stop the steam supply from the heater 154 of the steam generating unit 150 (S360). Then, the controller 161 controls to drive the fan 182 via the driving motor 186 of the fan 182 (S370). The controller 161 controls the fan 182 to be driven, and calculates a driving time of the fan 182 (S380). When the calculated driving time of the fan 182 is more than a preset driving time (S390), the controller 161 controls the inner tub 140 and the fan 182 to be stopped (S400). When the fan 182 is stopped, the controller 161 calculates a number of times the fan 182 was rotated during the calculated driving time by the number of times calculating unit 165 (S410). When the calculated number of times the fan 182 was rotated is less than a preset number of times (S420), the controller 161 repeatedly performs step S340 for rotating the inner tub 140 with a first speed through step S420 for comparing the accumulated calculated number of times the fan 182 was rotated with the preset number of times.

When the warm air supply mode is selected by the mode selecting unit 163 (S330), the controller 161 controls to rotate the inner tub 140 with a first speed by the driving motor 130 (S345). And, the controller 161 controls to supply steam into the inner tub 140 from the heater 154 of the steam generating unit 150 (S355). When a preset time for steam supply to the laundry lapses, the controller 161 controls to stop the steam supply from the heater 154 of the steam generating unit 150 (S365).

Once the steam supply is stopped, the controller 161 controls to drive the fan 182, and to apply power to the heater 192 of the odor removing module 190 (S375). Here, the temperature sensor 195 senses a temperature of air heated from the heater 192 (S385), and the controller 161 turns ON/OFF the heater 192 based on the sensed temperature (S395). The ON/OFF control is performed so as to rapidly remove odor of the laundry by supplying air of a preset temperature to the laundry. The controller 161 controls to drive the fan 182, and calculates a driving time of the fan (S405).

When the calculated driving time of the fan 182 is more than a preset driving time (S415), the controller 161 controls to stop the inner tub 140 and the fan 182, and turns off the heater 192 of the odor removing module 190 (S425). When the fan 182 is stopped, the controller 161 calculates a number of times the fan 182 was rotated during the calculated driving time by the number of times calculating unit 165 (S435). Then, the controller 161 compares the calculated number of times the fan 182 was rotated with a preset number of times (S445). When the calculated number of times the fan 182 was rotated is less than the preset number of times, the controller 161 repeatedly performs step S345 for rotating the inner tub 140 with a first speed through step S445 for comparing the accumulated calculated number of times the fan 182 was rotated with the preset number of times.

In the illustrated embodiments of the present invention, steam is supplied to laundry for moisture supply, and thus odor of the laundry is removed by the steam. Accordingly, water and detergent necessary to perform a cleaning process using water are not required for removing the odor, and a life-span of the clothes can be extended because the cleaning process using water is not used for removing the odor.

In addition, the method for removing odor of laundry in a washing machine according to the illustrated embodiments of the present invention comprises supplying steam to remove the odor of the laundry, and rotating an inner tub so as to remove moisture inside the laundry. Accordingly, the odor of the laundry is rapidly and easily removed, and a large capacity of heater and duct are not required. As a result, increment of fabrication cost due to the heater and the duct is prevented.

Moreover, the method for removing odor of laundry in a washing machine according to the illustrated embodiments of the present invention comprises supplying steam to remove the odor of the laundry, and supplying external air by driving the fan of the odor removing module so as to remove moisture inside the laundry. Accordingly, the odor of the laundry is rapidly and easily removed, and a large capacity of heater and duct are not required. As a result, increment of fabrication cost due to the heater and the duct is prevented.

Furthermore, the method for removing odor of laundry in a washing machine according to the illustrated embodiments of the present invention comprises supplying steam to remove the odor of the laundry, and supplying warm air by driving the fan and the heater of the odor removing module so as to remove moisture inside the laundry. Accordingly, the odor of the laundry is rapidly and easily removed, and a large capacity of heater and duct are not required. As a result, increment of fabrication cost due to the heater and the duct is prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for removing odor of laundry in a washing machine, the washing machine including: a cabinet, an outer tub installed in the cabinet, the outer tub having an inlet port for sucking external air outside of the outer tub into the outer tub therethrough, an outlet port for discharging internal air inside of the outer tub to outside of the outer tub, and an outlet pipe connected between the outlet port and the cabinet so as to exhaust air outside the cabinet, an inner tub rotatably installed in the outer tub, and a steam generating unit disposed outside the outer tub for generating steam, the method comprising:

before supplying the steam to the laundry located in the inner tub, rotating the inner tub at a first speed with the laundry located in the inner tub;

supplying the steam to the laundry located in the inner tub; and rotating the inner tub, wherein when the inner tub is rotated after the step of supplying the steam to the laundry located in the inner tub, the laundry is dehydrated, and the external air sucked through the inlet port into the outer tub is exhausted to outside of the cabinet through the outlet port and the outlet pipe.

2. The method of claim 1, after rotating the inner tub, further comprising:

calculating and accumulating a number of times the inner tub was rotated;

comparing the accumulated number of times with a preset number of times; and stopping the inner tub when the calculated number of times is more than the preset number of times, wherein when the accumulated number of times is less than the preset number of times, the steps of supplying the steam to the laundry and rotating the inner tub are repeatedly performed until the accumulated number of times reaches the preset number of times.

3. The method of claim 2, after comparing the accumulated number of times with the preset number of times, further comprising removing wrinkles of the laundry.

4. The method of claim 3, wherein the step of removing wrinkles of the laundry comprises:

supplying the steam into the outer tub; and rotating the inner tub.

5. The method of claim 3, after removing wrinkles of the laundry, further comprising cooling the laundry.

6. The method of claim 1, wherein the step of rotating the inner tub after supplying the steam to the laundry includes rotating the inner tub at a second speed faster than the first speed.

7. The method of claim 1, wherein when the step of supplying the steam to the laundry is performed, the inner tub is rotated.

8. The method of claim 1, wherein when the step of supplying the steam to the laundry is performed, the inner tub is rotated in forward and backward directions.

9. A method for removing odor of laundry in a washing machine, the washing machine including: a cabinet having a communication hole, an outer tub installed in the cabinet, the outer tub having an inlet port for directly sucking external air outside of the cabinet into the outer tub therethrough, an outlet port for discharging internal air inside of the outer tub to outside of the outer tub, and an outlet pipe connected between the outlet port and the cabinet so as to exhaust air outside the cabinet; an inner tub rotatably installed in the outer tub, an odor removing module installed at the communication hole, wherein the odor removing module is configured to allow suction of the external air outside of the cabinet into the outer tub by comprising a case having a suction opening and a discharge opening, a fan rotatably installed in the case, a driving motor for rotating the fan, and an inlet pipe having one end connected to the inlet port and another end connected to the discharge opening, and a steam generating unit disposed outside the outer tub for generating steam, the method comprising:

before supplying the steam to the laundry located in the inner tub, rotating the inner tub with the laundry located in the inner tub;

supplying the steam to the laundry located in the inner tub; and driving the fan of the odor removing module, wherein during the step of driving the fan, the external air outside of the cabinet is sucked by the fan into the outer tub via the suction opening, and is subsequently exhausted to outside of the cabinet via the outlet port and the outlet pipe together with an odorous material via the inside of the inner tub.

10. The method of claim 9, after driving the fan of the odor removing module, further comprising:

calculating and accumulating a number of times the fan was rotated;

comparing the accumulated number of times with a preset number of times; and stopping the inner tub and the fan of the odor removing module when the accumulated number of times is more than the preset number of times, wherein when the accumulated number of times is less than the preset number of times, the steps of supplying the steam to the laundry and driving the fan of the odor removing module are repeatedly performed until the accumulated number of times reaches the preset number of times.

11. The method of claim 9, wherein when the step of supplying the steam to the laundry is performed, the inner tub is rotated.

12. The method of claim 9, wherein when the step of supplying the steam to the laundry is performed, the inner tub is rotated in forward and backward directions.

13. A method for removing odor of laundry in a washing machine, the washing machine including: a cabinet having a communication hole, an outer tub installed in the cabinet, the outer tub having an inlet port for directly sucking external air outside of the cabinet into the outer tub therethrough, an outlet port for discharging internal air inside of the outer tub to outside of the outer tub, and an outlet pipe connected between the outlet port and the cabinet so as to exhaust air outside the cabinet; an inner tub rotatably installed in the outer tub; an inner tub rotatably installed in the outer tub, an odor removing module installed in the communication hole, wherein the odor removing module is configured to suck the external air outside of the cabinet into the outer tub by comprising a case having a suction opening and a discharge opening, a fan rotatably disposed in the case, a driving motor for rotating the fan, an inlet pipe having one end connected to the inlet port and another end connected to the discharge opening, and a heater for supplying warm air of 30° C. to 40° C., and a steam generating unit disposed outside the outer tub for generating steam, the method comprising:

before supplying the steam to the laundry located in the inner tub, rotating the inner tub with the laundry located in the inner tub;

supplying the steam to the laundry located in the inner tub;

selecting and performing one of an external air supply mode and a warm air supply mode, wherein the step of performing the external air supply mode includes supplying the external air through the suction opening, the inlet pipe and the inlet port into the outer tub and subsequently exhausting the external air that is introduced into the outer tub to outside of the cabinet through the outlet port and the outlet pipe by driving only the fan, and the step of performing the warm air supply mode includes supplying warm air to the laundry by driving the fan and the heater; and driving the odor removing module.

14. The method of claim 13, after driving the odor removing module, further comprising:

calculating and accumulating a number of times the odor removing module was driven;

comparing the accumulated number of times with a preset number of times; and stopping the inner tub and the odor removing module when the accumulated number of times is more than the preset number of times, wherein when the accumulated number of times is less than the preset number of times, the steps of supplying steam to the laundry and driving the odor removing module are repeatedly performed until the accumulated number of times reaches the preset number of times.

15. The method of claim 13, when the warm air supply mode is selected, further comprising:

detecting an air temperature at a lower side air of the heater; and controlling the heater based on the detected temperature.

16. The method of claim 13, wherein when the step of supplying the steam to the laundry is performed, the inner tub is rotated.

17. The method of claim 13, wherein when the step of supplying the steam to the laundry is performed, the inner tub is rotated in forward and backward directions.

* * * * *